US006113003A

United States Patent [19]

Condon

[11] Patent Number: 6,113,003

[45] Date of Patent: Sep. 5, 2000

[54] COMPRESSED AIR DUSTER WITH ROTATABLE AGITATOR

[75] Inventor: Gregory C. Condon, Batavia, N.Y.

[73] Assignee: Chapin Manufacturing, Inc., Batavia, N.Y.

[21] Appl. No.: 09/400,013

[22] Filed: Sep. 21, 1999

[51] Int. Cl.[7] ..... B05B 9/00

[52] U.S. Cl. ..... 239/142; 239/325; 239/333; 239/373; 239/398; 239/530; 222/226; 222/402; 366/279; 406/135

[58] Field of Search ..... 239/142, 302, 239/325, 333, 373, 398, 433, 525, 530; 366/241, 279; 222/226, 401, 402, 630; 406/134, 135

[56] References Cited

U.S. PATENT DOCUMENTS

| | | | |
|---|---|---|---|
| 587,890 | 8/1897 | Weaver | 239/142 |
| 2,450,205 | 9/1948 | Rose . | |
| 2,934,241 | 4/1960 | Akesson . | |
| 3,092,678 | 6/1963 | Braun | 239/142 X |
| 3,123,362 | 3/1964 | Elvers, Sr. . | |
| 3,412,937 | 11/1968 | Chamberlain . | |
| 3,672,645 | 6/1972 | Terrels et al. | 239/142 X |
| 4,192,464 | 3/1980 | Chow | 239/373 |
| 4,401,268 | 8/1983 | Pomponi, Jr. | 239/142 |
| 4,474,327 | 10/1984 | Mattson et al. . | |
| 4,553,698 | 11/1985 | Parker et al. . | |
| 5,161,473 | 11/1992 | Landphair et al. . | |
| 5,779,161 | 7/1998 | Dvorak . | |
| 5,785,245 | 7/1998 | Tedders, Jr. et al. | 239/142 X |

*Primary Examiner*—Andres Kashnikow
*Assistant Examiner*—Steven J. Ganey
*Attorney, Agent, or Firm*—Jaeckle Fleischmann & Mugel, LLP

[57] ABSTRACT

A hand-held compressed air duster apparatus comprises a pressurizable vessel for containing a fine particulate dusting material. The vessel has an upper shoulder provided with a sealable top opening, in which a hand pump is mounted and sealably connected to the top opening. The pump comprises an external handle connected to a piston extending into the vessel. A dust discharge outlet is disposed on the shoulder of the vessel. Located within the vessel are two concentric tubes. A rotatable outer tube having a closed lower end that is provided with a pivot foot in contact with the bottom of the vessel extends upwards to an open upper end that is in fluid communication with the interior of the vessel. The rotatable outer tube comprises a dust feed agitator pin extending outwardly from the outer surface of the tube. The rotatable outer tube further comprises a venturi disposed above and in close proximity to the dust feed agitator pin and an agitator weight mounted on the outer surface of the tube above the venturi. An inner tube has an open lower end and an upper end that is connected to the dust discharge outlet. Operating the handle actuates the pump to pressurize the vessel, which is manually rotated to impart motion to the agitator weight and dust feed agitator pin attached to the rotatable outer tube, thereby maintaining the venturi open to entry of fluidizable dust particles proximate the open venturi and providing a mechanism for discharging uniformly fluidized dust at a controlled rate from the discharge outlet.

16 Claims, 1 Drawing Sheet

COMPRESSED AIR DUSTER WITH ROTATABLE AGITATOR

FIELD OF THE INVENTION

The present invention relates to a duster apparatus and, more particularly, to a hand-held duster apparatus having a rotatable agitator and weight.

BACKGROUND OF THE INVENTION

Damage to growing plants is commonly controlled by the application of various dusts such as insecticides, pesticides, and fungicides. For treatment of large crop areas, dusting is typically carried out using airplanes or wheel-mounted rigs. For smaller crop areas, dusts are usually applied using hand-held dusting apparatus. However, because dusts used for crop treatment are generally very finely divided and heavily compacted, the use of hand-held apparatus to disperse them can be slow, tiresome work.

U.S. Pat. No. 2,450,205 to Rose discloses a powder dispenser having flexible resilient side members, rigid end members, a powder-exit tube, and an air-circulating tube. The ends of the air-circulating tube are provided with air-pervious, powder-impervious discs to prevent powder from entering it. In one form of the dispenser (cf. FIGS. 3, 4, 5), the powder-exit tube is positioned vertically within the air-circulating tube. In operation, the flexible side members are pressed inward, forcing air into the powder mass and agitating it. Upon release of the side members, the air in the powder mass is drawn inwardly through the powder-exit tube, carrying a portion of the powder with it.

U.S. Pat. No. 2,934,241 to Akesson discloses a dust gun apparatus having a container having a sloping lower end, with an impingement plate at its lowest portion. A small stream of air is directed at the plate, resulting in a small fluidizing zone at the bottom of the container. Fluidized dust is conveyed directly from the fluidizing zone to a venturi providing compressed air that carries the fluidized dust to the gun outlet.

U.S. Pat. No. 3,123,362 to Elvers, Sr. discloses a fertilizer gun having a conical hopper for dry fertilizer. A portion of a water supply from a garden hose is directed through a small bore tube to the bottom of the hopper, where it wets a portion of the dry fertilizer. The resulting slurry is forced up through a central pipe to a venturi, where it joins the main portion of the water supply and transported to a delivery nozzle.

U.S. Pat. No. 3,412, 937 to Chamberlain discloses a spray gun for paint that includes a paint supply container provided with an agitator having a paddle connected to a suspended rod. The agitator is actuated to stir the paint when the trigger of the spray gun is manually operated.

U.S. Pat. No. 4,474,327 to Mattson et al. discloses an apparatus to be used with a hand-held air blower for broadcasting fertilizer or other particulate material over a lawn or garden area. The apparatus, which includes an adapter nozzle with a venturi throat for passage of the discharge air stream and a supply container for the particulate material, provides for a portion of the discharge air stream to agitate and fluidize a localized region of the material in the container and coupling that region with the venturi throat by a suction tube to draw the fluidized material into the adapter nozzle for entrainment with the discharge air stream.

U.S. Pat. No. 4,553,698 to Parker et al. discloses a pneumatic duster apparatus for treating structures that includes a dust reservoir, a source of compressed air that is delivered to the reservoir through a flexible tube to agitate the dust to facilitate emptying the reservoir, and a metal discharge tube that is capable of imparting a friction-induced electrostatic charge to the exiting dust that causes it to adhere to treated surfaces.

U.S. Pat. No. 5,161,473 to Landphair et al. discloses an apparatus for distributing seed that includes a seed supply hopper, an air supply line connected to an air manifold that contains a plurality of outlets and extends to the bottom of the hopper, and a seed tube disposed within the manifold. Seeds are propelled from the bottom of the hopper upwards through the seed tube for metering and distribution.

U.S. Pat. No. 5,779,161 to Dvorak discloses an apparatus to be used with a conventional blower for dispensing powdered and granulated materials. The apparatus includes a container for the particulate material to be dispensed, an outlet tube that extends from the bottom of the container to an outlet orifice at the top of the container that is coupled with the blower, an air inlet tube that is in fluid communication with the end of the outlet tube at the outlet orifice and with a first air inlet orifice for the container, and a second inlet orifice for the container. Preferably, at least one of the air inlet orifices is equipped with a slidable door for controlling the area of the orifice and, consequently, the air flow through the orifice.

There is a continuing need for a hand-held dust apparatus that facilitates fluidizing dense dusts and provides convenient control of their rate of dispersal. This need is well met by the dust apparatus of the present invention.

SUMMARY OF THE INVENTION

The present invention is directed to a hand-held compressed air duster apparatus that comprises a pressurizable vessel for containing a fine particulate dusting material. The vessel has an upper shoulder provided with a sealable top opening, in which a hand pump is mounted and sealably connected to the top opening. The pump comprises an external handle connected to a piston extending into the vessel. A dust discharge outlet is disposed on the shoulder of the vessel.

Located within the vessel are two concentric tubes. A rotatable outer tube having a closed lower end that is provided with a pivot foot in contact with the bottom of the vessel extends upwards to an open upper end that is in fluid communication with the interior of the vessel. The rotatable outer tube comprises a dust feed agitator pin extending outwardly from the outer surface of the tube. The rotatable outer tube further comprises a venturi disposed above and in close proximity to the dust feed agitator pin and an agitator weight mounted on the outer surface of the tube above the venturi. An inner tube has an open bottom end and an upper end that is connected to the dust discharge outlet.

Operating the handle actuates the pump to pressurize the vessel, which is manually rotated to impart motion to the agitator weight and dust feed agitator pin attached to the rotatable outer tube, thereby maintaining the venturi open to entry of fluidizable dust particles proximate the open venturi and providing a mechanism for discharging uniformly fluidized dust at a controlled rate from the discharge outlet.

DETAILED DESCRIPTION OF THE INVENTION

Figure 1:
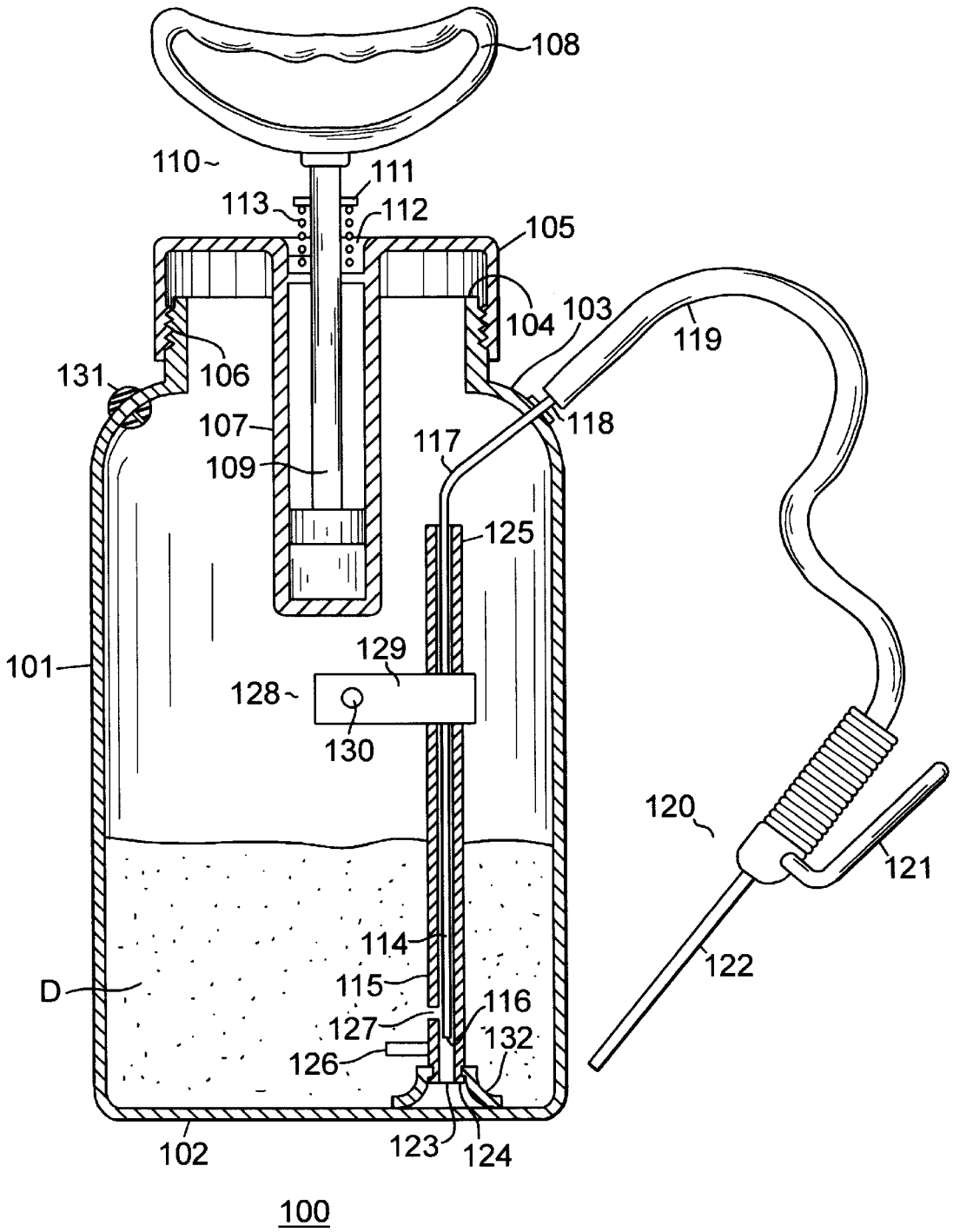
FIG. 1 is a side cross-sectional view of the dusting apparatus of the present invention.

Referring to FIG. 1, a dusting apparatus 100 in accordance with the present invention comprises a pressurizable vessel 101 having a bottom 102 and an upper shoulder 103 provided with a sealable top opening 104. A cap 105 is sealably attached to vessel 101 by, for example, corresponding screw threads 106. Vessel 101 and cap 105 can be formed from a metal such as, for example, stainless steel or a plastic such as, for example, polypropylene.

Cap 105 further provides a mount for a pump 107 comprising an external handle 108 and a piston 109 extending into vessel 101. Handle 108 can be releasably locked to cap 105 by a locking mechanism 110 that includes locking pins 111 that can be inserted into channel 112 against a bias provided by a spring 113. Rotating handle 108 a quarter-turn locks it with cap 105.

Also contained in vessel 101 are an inner tube 114 and a concentric rotatable outer tube 115. Inner tube 114 has an open lower end 116 and an upper end 117 connected to a dust discharge outlet 118, which is in turn connected to a hose 119 and thence to a dust delivery gun 120 comprising a trigger 121 and a nozzle 122.

Rotatable outer tube 115 has a lower end 123 closed by a pivot foot 124 and an open upper end 125 that is in fluid communication with the interior of vessel 101. Attached to outer tube 115 adjacent pivot foot 124 is a dust feed agitator pin 126. Above and in close proximity to agitator pin 126 is a venturi 127 in tube 115. Mounted on tube 15 above venturi 127, preferably at approximately the midpoint of tube 115, is an agitator weight 128, which can be in the shape of a block 129 having perpendicularly extending weighted side arms 130. Tubes 114 and 115, dust feed agitator pin 126, and agitator weight 128 can be formed of metal, preferably brass. Pivot foot 124, which can be formed of metal or plastic, is held in position by a bearing shoe 132 attached to vessel bottom 102.

In operation, a dusting material D is placed in vessel 101, which is pressurized by the up and down movement of pump handle 108. Air flows through open end 125 and down through outer tube 115. A mixture of air and dust flows through venturi 127 and meets the air flow in outer tube 115. The resulting fluidized air-dust mixture enters the open lower end 116 of inner tube 114 and flows upward to dust discharge outlet 118. Manual rotation of vessel 110 using locked pump handle 108 imparts motion to agitator weight 128, which in turn causes rotation of outer tube 115 and attached agitator pin 126. As air and dust are withdrawn from the region proximate venturi 127, the dust particles may agglomerate to prevent their entering venturi 127. Motion of agitator pin 126 disrupts this agglomeration, allowing the dust particles to be entrained in air, drawn into venturi 127, and pushed upwards in inner tube 114 towards discharge outlet 118. An optional pressure release valve 131 permits depressurization of vessel 101 as desired.

The apparatus of the present invention enables a quantity of dusting material in the vessel to be uniformly fluidized by compressed air via a venturi carburetor. The rate of dust discharge from the apparatus is readily controlled by rotational movement of the vessel manually provided by an operator.

Having thus described the preferred embodiment of the invention, those skilled in the art will appreciate that various modifications, additions, and other changes may be made thereto without departing from the spirit and scope of the invention, as set forth in the following claims.

What is claimed:

1. A hand-held compressed air duster apparatus comprising:

a pressurizable vessel for containing a fine particulate dusting material, said vessel having a bottom and an upper shoulder provided with a sealable top opening;

a hand pump mounted within said vessel and sealably connected to said top opening, said pump comprising an external handle connected to a piston extending into said vessel;

a dust discharge outlet disposed on said shoulder of said vessel;

two concentric tubes disposed within said vessel:

a rotatable outer tube having an outer surface and a closed lower end provided with a pivot foot in contact with the bottom of said vessel, said outer tube extending upwards to an open upper end in fluid communication with the interior of said vessel; said rotatable outer tube comprising a dust feed agitator pin extending outwardly from the outer surface of said tube; said rotatable outer tube further comprising a venturi disposed above and in close proximity to said dust feed control pin and an agitator weight mounted on the outer surface of said tube above said venturi; and an inner tube having a open bottom end and an upper end connected to said dust discharge outlet;

wherein actuating said pump by operating said handle pressurizes said vessel, and manually shaking said vessel imparts motion to said agitator weight and said dust feed agitator pin attached to said rotatable outer tube, thereby maintaining the venturi open to the entry of fluidizable dust particles proximate said open venturi, and enabling discharge of fluidized dust from said discharge outlet.

2. The duster apparatus of claim 1 further comprising a cap for sealably closing said top opening and for supporting said pump.

3. The dusting apparatus of claim 2 wherein said top opening and said cap are provided with corresponding screw threads for sealably closing said vessel.

4. The dusting apparatus of claim 2 wherein said handle of said pump and said cap are provided with a handle lock for releasably locking said handle to said cap.

5. The dusting apparatus of claim 1 wherein said concentric tubes, said dust feed agitator pin, and said agitator weight are each formed from metal.

6. The dusting apparatus of claim 5 wherein said metal is brass.

7. The dusting apparatus of claim 1 wherein said open lower end of said inner tube and said venturi are each disposed proximate said closed lower end of said outer tube.

8. The dusting apparatus of claim 1 wherein said rotatable outer tube extends upwards to approximately the shoulder of said vessel.

9. The dusting apparatus of claim 1 wherein said agitator weight is mounted on the outer surface of the outer tube at approximately the midpoint of said tube.

10. The dusting apparatus of claim 1 wherein said dust discharge outlet is connected to a hose, said hose being connected in turn with a dust delivery gun.

11. The dusting apparatus of claim 10 wherein said dust delivery gun comprises a trigger and a nozzle.

12. The dusting apparatus of claim 1 wherein said vessel further comprises a pressure release valve.

13. The dusting apparatus of claim 1 wherein said vessel is substantially cylindrical in shape and is formed from metal or plastic.

14. The dusting apparatus of claim 13 wherein said vessel is formed from stainless steel or polypropylene.

15. The dusting apparatus of claim 1 wherein said pivot foot is formed from metal or plastic.

16. The dusting apparatus of claim 1 wherein said pivot foot is disposed within a bearing shoe connected to said bottom of said vessel.

* * * * *